United States Patent [19]

Holobaugh, Jr.

[11] 4,352,523

[45] Oct. 5, 1982

[54] MANUALLY-OPERATED SPRING-ASSISTED RECLINING CHAIRS

[75] Inventor: Raymond E. Holobaugh, Jr., Tupelo, Miss.

[73] Assignee: Mohasco Corp., Amsterdam, N.Y.

[21] Appl. No.: 164,500

[22] Filed: Jul. 2, 1980

[51] Int. Cl.[3] ..... A47C 1/02

[52] U.S. Cl. ..... 297/85; 297/68; 297/83; 297/84; 297/317

[58] Field of Search ..... 297/84, 85, 86, 87, 297/61, 68, 88, 89, 75, 83, DIG. 7, 317, 318, 316, 341, 342, 343; 5/12 R, 37 R, 47

[56] References Cited

U.S. PATENT DOCUMENTS

| | | | |
|---|---|---|---|
| 1,366,419 | 1/1921 | Richardson | 5/12 R |
| 1,377,605 | 5/1921 | Starks | 297/68 X |
| 2,872,260 | 2/1959 | Walter | 108/82 X |
| 3,300,243 | 1/1967 | Mizelle | 297/85 |
| 3,357,739 | 12/1967 | Knabusch et al. | 297/84 X |
| 3,603,641 | 9/1971 | Knabusch | 297/85 X |
| 3,730,585 | 5/1973 | Rogers, Jr. et al. | 297/85 |
| 3,813,150 | 5/1974 | Katz | 297/85 X |
| 4,071,275 | 1/1978 | Rogers, Jr. | 297/85 |
| 4,072,342 | 2/1978 | Johnson et al. | 297/84 |
| 4,212,494 | 7/1980 | Dabney | 297/84 X |
| 4,216,991 | 8/1980 | Holobaugh | 297/322 X |
| 4,226,468 | 10/1980 | Johnson | 297/84 |
| 4,226,469 | 10/1980 | Rogers, Jr. et al. | 297/85 |
| 4,249,772 | 2/1981 | Rogers, Jr. | 297/68 X |
| 4,291,913 | 9/1981 | Kowalski | 297/317 |
| 4,307,912 | 12/1981 | Watt et al. | 297/85 |

*Primary Examiner*—James T. McCall

*Attorney, Agent, or Firm*—Kirschstein, Kirschstein, Ottinger & Cobrin

[57] ABSTRACT

A spring-assisted trigger handle assembly for a three-way, wall-proximity reclining chair which is movable from an end-limiting upright position, to a TV position, and then to an end-limiting fully-reclined position. The handle assembly is operative for affirmatively forwardly driving the linkage system for the chair only as the latter is moved from its initial upright position to an intermediate chair position which is between the two end-limiting chair positions. A tensioned spring assists the handle assembly in forwardly driving the linkage system once the handle assembly has moved the chair to the general vicinity of the intermediate chair position. The body weight of a seated user is thereupon conveniently utilized to assist the spring at the end of its operation to move the chair to the TV position. The tensioned spring secures the chair in the upright position in an over-center locked condition until the handle assembly causes the spring to suddenly release its stored energy. The handle assembly eventually disengages from the linkage system when the chair reaches the intermediate position. A handle for the handle assembly is freely returnable by gravity to its initial position.

25 Claims, 7 Drawing Figures

MANUALLY-OPERATED SPRING-ASSISTED RECLINING CHAIRS

BACKGROUND OF THE INVENTION

1. Field of the Invention

The present invention relates generally to the art of reclining chairs and, more particularly, is directed to manually-operated wall-proximity chairs.

2. Description of the Prior Art

Handle-operated reclining chairs are well known in this art. Typically, a handle is mounted within hand-reach of a seated user, and is turned to effect reclining movement of the seat and the backrest from the upright position to the fully-reclined position, and/or to effect extension of the footrest. The prior art recliner handles are also used to return the seat and the backrest from the fully-reclined position back to the upright position, and/or to retract the footrest.

Although generally satisfactory for its intended purpose, the handle for the prior art reclining chair requires a relatively large amount of muscular effort on the occupant's part to both forwardly and rearwardly move the seat, the backrest and the footrest. The prior art handle is kinematically connected to the recliner and the footrest linkage mechanisms of the known reclining chairs such that each position of the handle has a one-to-one correspondence with a distinct position of the chair.

In order to operate the prior art chairs, a relatively long handle is required to reduce the amount of muscular effort otherwise required. However, long massive handles are aesthetically displeasing and also pose a safety hazard.

It has heretofore been proposed in application U.S. Ser. No. 082,810, filed Oct. 9, 1980, for Manually-Operated Reclining Chairs, now U.S. Pat. No. 4,291,913, assigned to the same assignee as the instant application, to provide a trigger handle assembly for a two-position incliner chair, wherein the trigger handle assembly was operative to move the incliner from an upright position to an intermediate chair position, wherein the body weight of a seated user took over to drive the chair further forwardly to the fully-reclined position. This trigger handle assembly disengaged from the chair linkage once the chair reached the aforementioned intermediate position, and hence, was no longer active in driving the chair past the intermediate position.

Wall-proximity reclining chairs are characterized by the large forward distance through which the seat and the backrest must be moved so that the back of the chair will not strike the wall behind the chair for any of the advanced reclining positions of the chair. The trigger handle assemblies used for incliners are not satisfactory for wall-proximity chairs, because these handle assemblies cannot move the chair through the aforementioned requisite large forward distance.

SUMMARY OF THE INVENTION

Objects of the Invention

Accordingly, it is the general object of the present invention to overcome the aforementioned drawbacks of the prior art.

Another object of the present invention is to equip a three-way wall-proximity chair with a trigger handle assembly which is capable of moving the chiar through the large forward distance necessary for proper wall-proximity chair operation.

Still another object of the present invention is to provide a reliable manually-operated, spring-assisted, wall-proximity reclining chair.

Another object of the invention is to reduce the amount of muscular effort required to operate a wall-proximity recliner.

Still another object of the present invention is to provide a wall-proximity reclining chairs which can be easily opened, even by persons of limited strength, such as children.

A further object of this invention is to provide a novel spring-assisted trigger handle assembly which is durable in construction, easy-to-operate and inexpensive to manufacture.

Features of the Invention

In keeping with these objects and others which will become apparent hereinafter, one feature of the invention resides, briefly stated, in a wall-proximity chair of the type which has a stationary base for supporting the chair on a floor; body-supporting means including a seat located above the base, and a backrest located rearwardly of the seat; an armrest located at each side of the seat; and a recliner system at each armrest. Each recliner system kinematically interconnects the body-supporting means to the base for reciprocal movement relative thereto in both the forward and rearward directions along a path which extends between an end-limiting upright chair position and an end-limiting fully-reclined chair position.

In accordance with the improvement of this invention, manually-actuatable means or a trigger handle assembly is provided for moving the body-supporting means along the path only in the forward direction from the upright chair position towards an intermediate chair position which is located between the end-limiting chair positions. Furthermore, assist means, such as an energy-storing tensionable spring, is provided for moving the body-supporting means further forwardly along the path past the intermediate chair position after the handle assembly has moved the body-supporting means to the general vicinity of the intermediate chair position.

The handle assembly includes an actuator member or handle mounted on the armrest within hand-reach of a seated user. The handle is displaceable along a working stroke from a trigger-start position which corresponds to the upright chair position, to a trigger-end position which corresponds to the aforementioned intermediate chair position. The handle assembly is in force-transmitting relationship with, and affirmatively forwardly drives, the recliner system throughout the displacement of the handle as it is moved from its trigger-start towards its trigger-end position, thereby forwardly moving the body-supporting means downstream of the path towards the intermediate chair position. The handle assembly is in impositve engagement, and out of force-transmitting relationship with, the recliner system when the handle reaches its trigger-end position, thereby disengaging the handle assembly from the recliner system and permitting the latter and the body-supporting means to be moved forwardly further downstream of the path towards the fully-reclined position in response to the operation of the spring and to the occupant's body weight acting on the recliner system.

This operation is very advantageous in that the amount of muscular effort required is not high and is easily within the capabilities of persons of limited strength.

After the handle assembly has disengaged from the recliner system, i.e. when the handle has reached its trigger-end position, the handle is freely returnable from its trigger-end position to its trigger-start position under the influence of gravity. Due to the one-to-one correspondence of the position of the prior art recliner handle to the position of the chair, the prior art recliner handles do not disengage from their respective linkage systems, and therefore do not automatically return to their initial positions. The prior art recliner handles which remain extended when the chair is in the TV or fully-reclined position pose a safety hazard which is overcome by the automatic handle return feature of this invention.

The spring is movable by the handle along an assist stroke between an assist-start position in which the spring exerts a relatively larger driving force on the recliner system, and an assist-end position in which the spring exerts a relatively lesser driving force.

Yet another feature of this invention is embodied in moving the spring to its assist-start position before the handle reaches its trigger-end position. Put another way, the spring and the handle are both simultaneously operative during an intermediate portion of the path so that the chair's movement is smoother during the transition from the handle drive to the spring drive. For this same purpose, the user's body weight is used to forwardly drive the chair at the end of the assist stroke.

The wall-proximity chair of this invention is thus initially driven solely by the handle, thereupon jointly by the handle and the spring, thereupon solely by the spring, and thereupon jointly by the spring and the user's body weight. The spring is primarily responsible for moving the chair through the large forward distance required for proper operation of a wall-proximity reclining chair.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
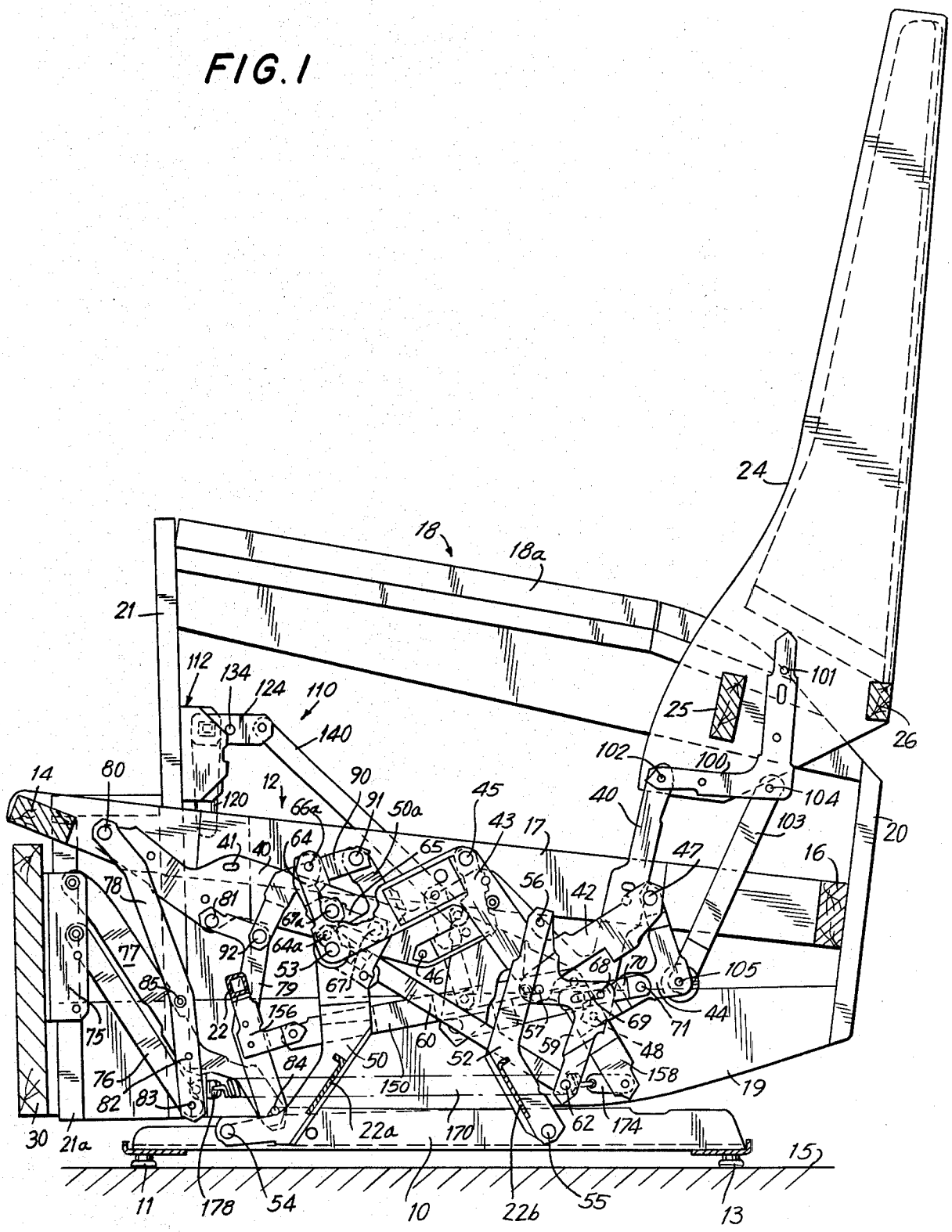
FIG. 1 is a cross-sectional side view of a preferred embodiment of a three-way wall-proximity reclining chair in the upright-closed chair position, showing the recliner and footrest linkage systems at the inner wall of the armrest, and showing the spring-assisted trigger handle assembly at the outer wall of the armrest in accordance with the present invention.

Referring initially to FIG. 1, a three-way, wall-proximity reclining chair is shown equipped with the spring-assisted trigger handle assembly in accordance with this invention. The reclining chair comprises a stationary base 10 having a floor-engaging front base support 11 and a floor-engaging rear base support 13, both supports being operative for supporting the chair on a floor 15.

The chair also comprises body-supporting means including a seat 12 located generally above the base 10, and a backrest 24 located rearwardly of the seat. The seat 12 includes a transversely-extending front frame rail 14, a transversely-extending rear frame rail 16 and a longitudinally-extending seat rail 17 connected to the rails 14, 15 at opposite sides of the seat. The backrest 24 includes cross rails 25, 26 extending transversely of the seat.

The chair further comprises a pair of interconnected armrests 18 (only the far armrest, i.e. the armrest at the right side of the chair as considered from the viewpoint of a seated user, has been shown) located at opposite sides of the seat. Each armrest includes a longitudinally-extending upper frame member **18*a*, a longitudinally-extending bottom frame member 19, a generally vertical rear frame member 20, a generally vertical intermediate frame member 21, and a generally vertical front frame member 21*a*. Each armrest 18 is respectively fixedly secured to each seat rail 17 (see FIG. 6**) such that the interconnected armrests and the seat are movable as a unit relative to the base along the forward and rearward directions, as described in detail below.

The chair still further comprises an ottoman or footrest 30 located at the front of the chair. As described below, the footrest 30 is movable between a retracted storage position and an extended position.

An integrated all-linkage system is mounted on each armrest, and kinematically interconnects the body-supporting means 18, 24 and the footrest 30 to the stationary base 10. The following description relates only to the linkage system employed on the far side of the chair. It will be understood that a similar linkage system is located on the non-illustrated near armrest. The two linkage systems are interconnected for joint movement by the front, intermediate and rear cross-rails 22, **22*a*, 22*b***, respectively.

Figure 3:
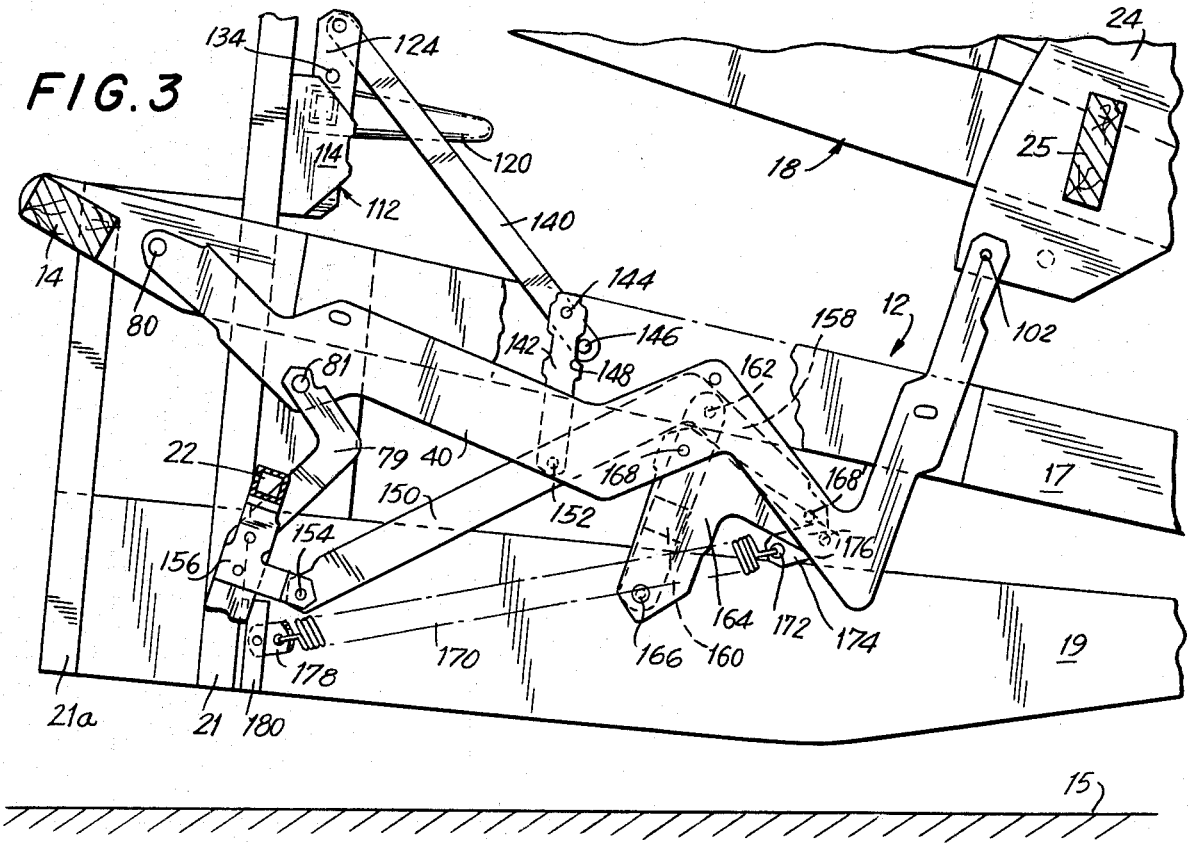
FIG. 3 is a view analogous to FIG. 2, but showing the chair in an intermediate chair position just after the assist spring begins to forwardly drive the recliner system.
Figure 4:
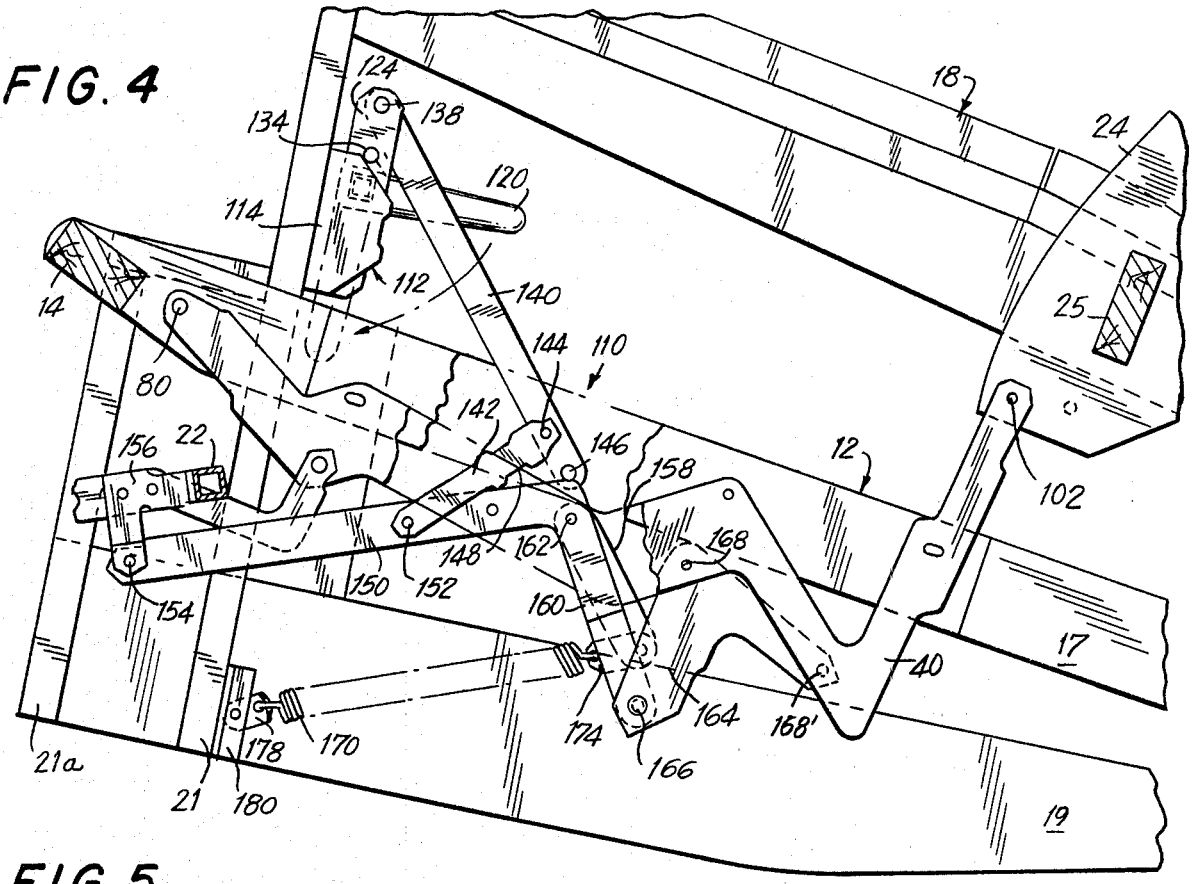
FIG. 4 is a view analogous to FIG. 2, but showing the chair in the TV position.
Figure 5:
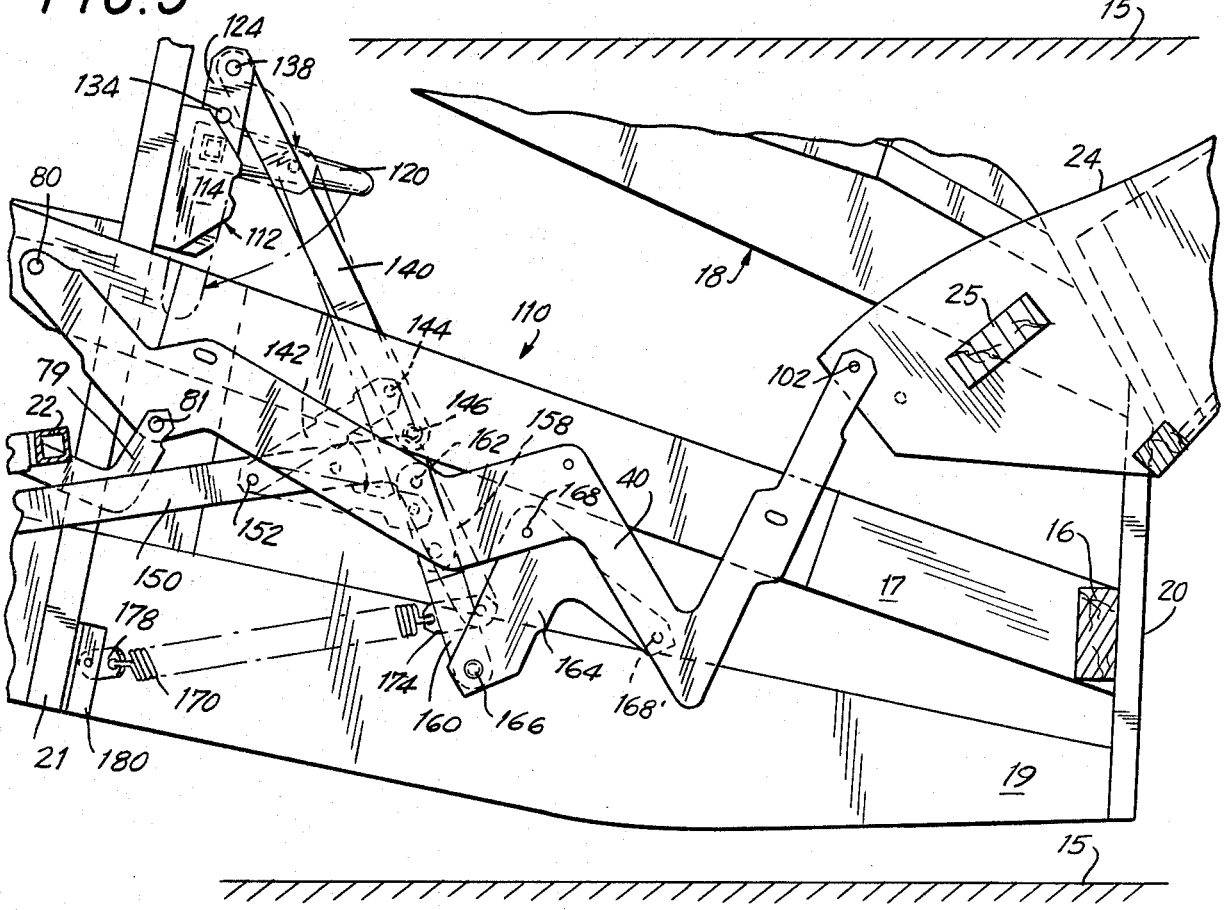
FIG. 5 is a view analogous to FIG. 2, but showing the chair to the fully-reclined chair position.

The all-linkage system reciprocally moves the body-supporting means and the footrest relative to the base in the forward and rearward directions along a multi-position path which extends from an end-limiting upright or closed chair position (FIG. 1 or FIG. 2), to an intermediate chair position (FIG. 3), thereupon to a partially-reclined TV chair position (FIG. 4), and thereupon to an end-limiting fully-reclined chair position (FIG. 5). In the upright position of FIG. 1 or FIG. 2, the seat 12 and the backrest 24 are both slightly rearwardly inclined, and the footrest 30 is generally vertically oriented at the front of the chair. In the intermediate chair position of FIG. 3, the seat and the backrest have been moved slightly forwardly, are slightly further rearwardly inclined, but have not moved relative to each other; and the footrest is slightly extended. In the TV chair position of FIG. 4, the seat and the backrest have been moved further forwardly, are still further rearwardly inclined, but still have not moved relative to each other; and the footrest is fully extended. In the fully-reclined chair position of FIG. 5, the seat and the backrest have been moved still further forwardly, are still rearwardly inclined, and have moved relative to each other; and the footrest remains fully extended.

The all-linkage system includes a recliner system primarily responsible for moving the body-supporting means, and a footrest system primarily responsible for moving the footrest.

The recliner and footrest linkage system shown in FIG. 1 are merely exemplary and form no essential part of this invention, which is, as noted above, directed essentially to the improvement of the spring-assisted trigger handle assembly. Many other types of recliner and footrest linkage systems can be satisfactorily used with the spring-assisted trigger handle assembly of this invention. The exemplary recliner and footrest systems shown in FIG. 1 are essentially identical in structure and operation to that shown and described in U.S. application Ser. No. 054,956, filed July 3, 1979, for Wall-Avoiding Recliner Chair, now U.S. Pat. No. 4,249,913 which has been assigned to the same assignee as this application; the entire contents of U.S. Pat. No. 4,249,772 being hereby incorporated by reference.

In order to simplify comparison of the recliner and footrest systems illustrated in the instant drawings with the recliner and footrest systems illustrated in U.S. Pat. No. 4,249,772, like reference numerals have been used. Thus, each recliner system comprises a seat-mounting member or seat link 40 having mounting apertures 41 through which fasteners are passed to rigidly secure the seat link 40 to the seat rail 17. The set is suspended from a carrier link 42 by an L-shaped front seat mounting link 43 and an L-shaped rear seat mounting link 44. The upper end of front seat mounting link 43 is pivotally connected to carrier link 42 at pivot 45, and the lower end of front seat mounting link 43 is pivotally connected to the seat link 40 at pivot 46. The upper end of rear seat mounting link 44 is pivotally connected to carrier link 42 at pivot 47, and the lower end of rear seat mounting link 44 is pivotally connected to seat link 40 at pivot 48.

The carrier link 42 is mounted for movement relative to the base 10 by a front carrier mounting link 50 and a rear carrier mounting link 52. Front carrier link 50 is pivotally connected to carrier link 42 at pivot 53, and is pivotally connected to the base 10 at pivot 54. Rear carrier link 52 is pivotally connected to the base 10 at pivot 55, and is pivotally connected to a Z-shaped rear sequence link 59 at pivot 56. The rear sequence link 59 is in turn pivotally connected to the carrier link 42 at pivot 57.

One modification to the recliner system shown in U.S. Pat. No. 4,249,772 is that the armrest link has been eliminated for the instant chair. It will be recalled that the seat and the armrests of the instant invention are interconnected so that movement of the seat automatically causes movement of the armrests. The spring-assisted trigger handle assembly described below initiates the seat movement. By contrast in the U.S. Pat. No. 4,249,772, the seat and the armrests are not interconnected, and the armrests, in response to urging by the user, are primarily responsible for initiating the seat movement. Hence, the armrest link of U.S. Pat. No. 4,249,772 has been replaced by straight strap link 60 which is pivotally connected at its rear end to the sequence link 59 at pivot 62, and at its front and to a front strap mounting link 64 at pivot **64*a*. The upper end of front strap mounting link 64 is pivotally connected to the carrier link 42 at pivot 66*a***.

A drive transmission link 65 is pivotally connected at its opposite ends at pivots **67*a*, 67 to the front strap link 64 and the front carrier mounting link 50**.

A sequencing mechanism is operative to prevent relative movement between the seat link 40 and the carrier link 42 when the chair is in the upright position or when moving to the TV position. The sequencing mechanism includes a stop pin 68 received in a sequencing slot 69 formed in a sequencing link 70. The sequencing link 70 is pivotally connected to rear seat mounting link 44 at pivot 71. As described in the co-pending application, the stop pin 68 lockingly engages against the side walls of the slot 69 when the chair is in the upright position and when the chair moves to the TV position. This locking engagement prevents the seat link 40 from moving relative to the carrier link 42. However, once the chair is in the TV position, the geometrical relationship of the links 59, 70 is such that the stop pin 68 can slide along the slot 69. This permits the seat link 40 to move relative to carrier link 42, and the seat can be reclined to the more advanced reclining positions. The seat is moved by the chair occupant exerting pressure on the backrest and, in turn, on the backrest linkage, to drive the rear seat mounting link 44 and swing the same forwardly about its pivot 47.

The backrest linkage includes a backrest link 100 having apertures 101 for fastening the backrest link 100 to the backrest 24. Link 100 is pivotally connected to seat link 40 at pivot 102, and to backrest drive link 103 at pivot 104. The lower end of backrest drive link 103 is pivotally connected to rear seat mounting link 44 at pivot 105. Once the chair reaches the TV position, pressure on the backrest 24 causes the drive link 103 to swing rear seat mounting link 44 forwardly and upwardly about pivot 47, thereby pivoting seat link 40 into the desired reclining position.

The footrest system comprises a footrest bracket link 75, a pair of lazy tong-type links 76,77 pivotally connected at their outer ends to bracket 75. A first footrest link 78 is pivotally connected to link 76 at pivot 83, and to seat link 40 at pivot 80. Link 77 is pivotally connected at pivot 82 to link 78 so that links 76,77 extend generally parallel to each other. A second L-shaped footrest link 79 is pivotally connected at its lower end to link 77 at pivot 84 and at its upper end to seat link 40 at pivot 81. An L-shaped idler actuating link 90 is connected at its lower end to the second footrest link 79 at pivot 92, and at its upper end to the upper part **50*a* of the front carrier mounting link 50 at pivot 91. Stop 85 abuts against a front portion of link 77 to define the retracted position, and abuts against a rear portion of link 77** to define the fully extended position.

In accordance with this invention, a spring-assisted trigger handle assembly 110 comprised of manually-actuatable means and assist means is provided for forwardly driving the all-linkage system and for moving the body-supporting means forwardly from the upright position towards the fully-reclined position. As will be explained in greater detail below, the assembly 110 does not affirmatively positively drive the all-linkage system all the way to the fully-reclined position. Instead, the manually-actuatable means is operative for affirmatively forwardly moving the body-supporting means to an intermediate chair position which is located intermediate the end-limiting positions of FIGS. 2 and 5. Furthermore, the assist means is operative for affirmatively forwardly moving the body-support means past the intermediate chair position. Preferably, for smoother more uniform chair movement, the assist means becomes actively operative just before the manually-actuatable means becomes inoperative. Similarly, just before the assist means becomes inoperative, the body weight of the seated user is then conveniently used as a component part of the driving force which moves the chair further forwardly.

In a preferred embodiment, the driving force generated by the manually-actuatable means, the assist means and the user's body weight are employed to move the body-supporting means from the upright position to the TV position. Thereupon, the body-supporting means is moved to the fully-reclined position, or to any position between the TV position and the fully-reclined position, solely by the user exerting pressure on the backrest.

Figure 6:
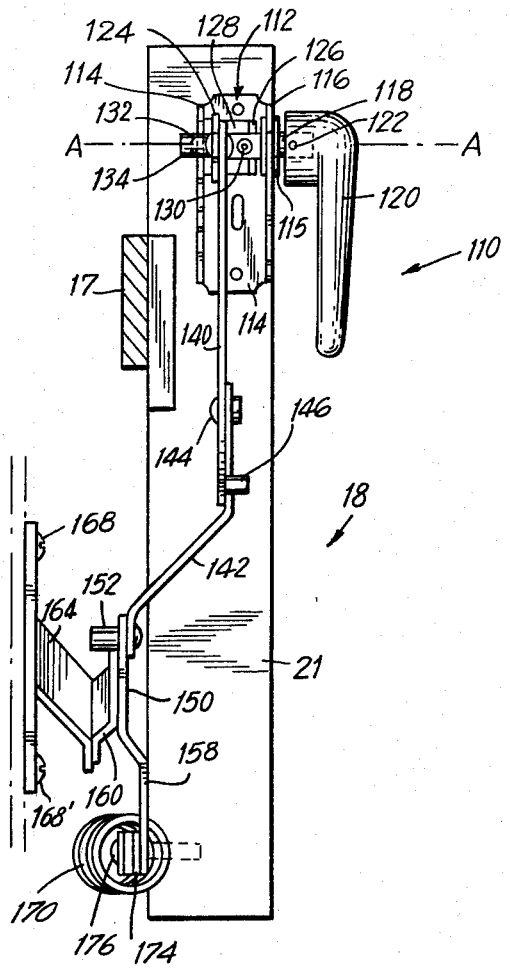
FIG. 6 is an elevational rear view of the spring-assisted trigger handle assembly as taken on line 6—6 of FIG. 2.

As best shown in FIG. 6, the manually-actuatable means comprises a channel-shaped handle bracket 112 having an armrest-engaging base wall 114 and a pair of side walls 114, 116. A hollow tubular square handle shaft 118 is mounted on and extends through side wall 116 for rotation about pivot axis A—A. A plastic nylon anti-friction bushing 115 journals shaft 118. A pull-up handle or actuator member 120 is fixedly mounted on the outer end of handle shaft 118 by set screw 122. The handle 120 is elongated and is mounted on shaft 118 so as to extend generally vertically downwardly when the chair is in the upright position.

A handle link 124 is fixedly mounted on the inner end of handle shaft 118 for joint movement therewith. The forward end portion of the handle link 124 is L-shaped, and has a bifurcated tip 126 which engages opposite sides of the square shaft 118, and has a flange portion 128 which is fixedly connected to the shaft 118 by fastener 130. The handle link 124 is pivotally connected on side wall 114 at pivot point 132 which lies on the pivot axis A—A.

A stop pin 134 is mounted on the handle link 124 intermediate the opposite ends thereof. The stop pin 134 engages a lower part of the inclined abutment surface 136 of the side wall 114 when the chair is in the upright position, thereby defining a first end-limiting handle position for the handle. The stop pin 134 engages an upper part of the inclined abutment surface 136 when the chair is in the TV position, thereby defining a second end-limiting handle position for the handle, which now extends generally horizontally relative to the floor. The arc length distance through which the handle turns between its end-limiting handle positions is the operating stroke for the handle. In the illustrated embodiment, the operating stroke is preferably on the order of 90°. However, it will be understood that the operating stroke may constitute arc lengths of either less than 90° or more than 90°. In fact, the arc length may constitute virtually any number of degrees between 0° and 360°.

The rear end of handle link 124 is pivotally connected to the front end of a drive link 140 at pivot point 138. An intermediate portion of the drive link 140 is pivotally connected to the upper end of a driven link 142 at pivot point 144. A drive member or force-transmitting pin 146 is mounted on the rear end of the drive link 140 for joint movement therewith. The lower end of the driven link 142 is pivotally connected to an intermediate part of a push link 150 at pivot point 152.

The driven link 142 is formed with a notch 148 intermediate its opposite pivot points 144,152. The force-transmitting drive pin 146 is received in notch 148 and physically engages the driven link 142 when the chair is in the upright position.

The front end of the push link 150 is pivotally connected to a push bracket 156 at pivot point 154. The push bracket is fixedly mounted on a forward part of the all-linkage system, preferably the footrest link 79. The aforementioned cross rail 22 is mountable on the push bracket 156.

Turning now to the assist means, a rear extension 158 is integrally connected to, and extends generally downwardly of, the push link 150. A radius link 160 has one end pivotally connected to an upper portion of the rear extension 158 at pivot point 162, and its opposite end pivotally connected to a support bracket 164 at pivot point 166. The support bracket 164 is fixedly connected to the seat link 40 by fasteners 168, 168'.

An energy-storing tensionable member, preferably an elongated helical spring 170, has one end connected at connection point 172 to one end of a short spring support link 174 whose other end is connected to the rear extension 158 at pivot point 176. The opposite end of the spring 170 is connected to a spring support link 178 which, in turn, is fixedly anchored on the rear of the vertical armrest 21 by spring bracket 180.

The spring-assisted trigger handle assembly 110 operates as follows: As the pull-up handle 120 is turned by the user about the pivot axis A—A from the vertical (FIG. 2) towards its horizontal (FIG. 4) orientation, the handle link 124 participates in this turning movement due to the fixed mounting of the latter to the handle 120. As best shown in FIG. 3, the handle link 124 transmits this turning force to the drive link 140 to forwardly move and upwardly lift the latter. The drive pin 146 is likewise moved forwardly and upwardly, and forwardly pushes the driven link 142 to pivot about its pivot point 152 due to the physical force-transmitting driving contact between the drive pin 146 and the driven link 142 during handle operation. As the driven link 142 is being forwardly moved and turned about its pivot point 152, the push link 150 is being concomitantly urged forwardly. The force-transmitting connection between the push link 150 and the footrest link 79 at the push bracket 156 causes the footrest link 79 and, in turn, the footrest linkage system to be driven forwardly. Due to the incorporation of the footrest linkage system with the recliner linkage system as one all-linkage system, the recliner linkage system is likewise driven forwardly due to force transmission along the seat link 40. The front and rear seat carrier links 50 and 52 are pivoted forwardly about their respective base pivot points 54 and 55, respectively. The remaining links of the recliner system move as described in the aforementioned U.S. Pat. No. 4,249,772, and hence, their operation has not been repeated herein for the sake of brevity, and because their operation form no essential part of this invention.

During the forward movement of the push link 150, its rear extension 158 is being moved forwardly and upwardly. The rear extension 158 orbits along a generally circular arc whose instantaneous center is pivot point 166 due to the connection of the linearly-extending radius link 160 between the rear extension 158 of the push link 150 and the support bracket 164.

Figure 2:
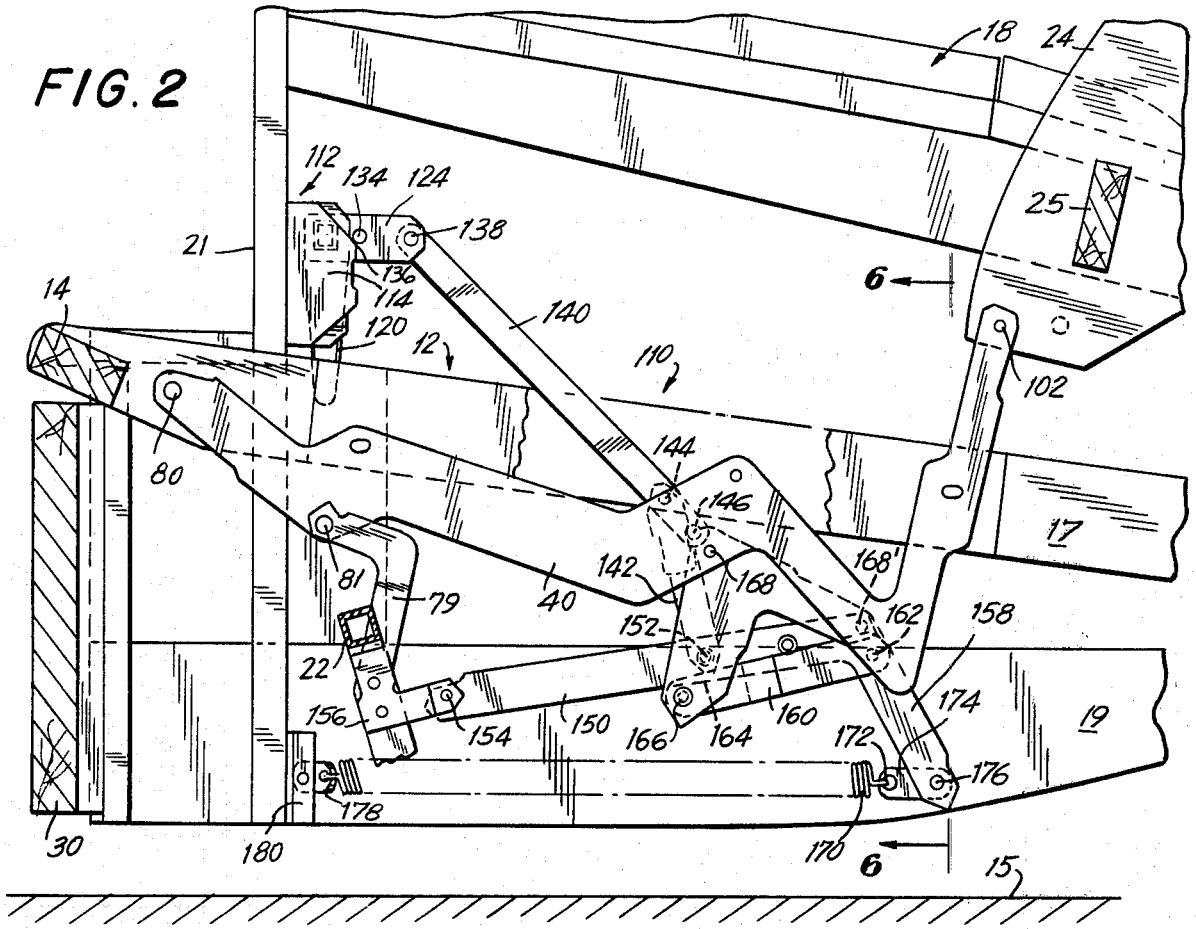
FIG. 2 is a view analogous to FIG. 1 with broken-away portions and with certain links of the recliner and footrest linkage systems removed for clarity to show the spring-assisted trigger handle assembly.

The spring 170 is stretchable between a normally-relaxed shorter configuration (FIG. 5) and a highly tensioned longer configuration (FIG. 2). The more stretched the spring is, the greater the amount of energy stored by the spring and, in turn, the greater the magnitude of the return force generated by the spring itself to restore it to its original relaxed configuration.

As best shown in FIG. 2, the greatly tensioned spring 170 is generally horizontally oriented, and is connected to the rear extension 158 at a point 176 which is lower in elevation as compared to the pivot point 166. The return force of the spring, therefore, continuously exerts a clockwise-acting force on the radius link 160 which is directed underneath the pivot point 166. This clockwise-acting force also serves to return the various links to their initial starting positions as shown in FIG. 2, thereby serving to initially lock the chair in its closed position.

The spring force acting to turn the radius link 160 in clockwise direction is counterbalanced by the counter-clockwise-acting force exerted on the radius link by the user during the manual actuation of the handle 120. It will be recalled that a force-transmission path exists between the handle 120, the handle link 124, the drive link 140, the drive pin 146, the driven link 142, the push link 150 and the radius link 160, as the handle is turned to drive the radius link about the pivot point 166.

The spring tension is such that it is sufficiently great to lock the chair in the FIG. 2 position when no manual force is exerted on the handle, but is sufficiently less than the manual force exerted by the user during handle operation to permit the handle to be easily and controllably turned against the spring return force. The rear end of the spring (at 172) is lifted relative to the anchored front end of the spring (at 178) during handle operation such that the spring is moved away from its initial horizontal configuration, and is successively inclined.

As the spring is being successively inclined, eventually a first intermediate chair position is reached where the return spring force is no longer being directed in counter-clockwise direction underneath the pivot point 166, but instead is being directed above the pivot point 166. As best shown in the first intermediate chair position of FIG. 3, the spring return force, which acts lengthwise of the linear spring, now is directed above the pivot point 166, because the spring has physically passed above the pivot point 166. The return spring force now assists the force generated by the handle to further forwardly pivot the radius link 160 about its pivot point 166 which, in turn, causes the push link 150 to be pushed even further forwardly and, concomitantly, causes the recliner system, footrest system, seat, and backrest to be driven even further forwardly.

The manual force generated by the handle 120 and the automatic spring return force generated by the spring, once the spring has been elevated over the pivot point 166, both cooperate to move the chair further forwardly towards the TV position of FIG. 4. However, before the TV position is reached, a second intermediate chair position is obtained, wherein the drive pin 146 is drivingly disengaged from the driven link 142. Put another way, the handle 120 is no longer operative for driving the chair forwardly, and the spring 170 takes over the driving function. Once the spring 170 takes over the primary responsibility for moving the chair away from the second intermediate chair position towards the TV position, the push link 150 and the driven link 142 are moved forwardly away from the drive pin 146, thereby disengaging the drive pin 146 from the driven link 142 (see FIGS. 4 and 5). The user can now let go of the handle 120 which thereupon will freely fall under the influence of gravity to its original vertical orientation, as diagramatically illustrated by the arrows and phantom lines in FIGS. 4 and 5.

As best shown in the TV position of FIG. 4, the spring 170 has released most of its stored energy, and the drive pin 146 is drivingly disengaged from the driven link 142. However, just before the chair reaches its TV position, eventually a third intermediate chair position is reached, wherein the body weight of the seated user becomes operative and assists the spring in driving the recliner and footrest systems forwardly. The user's body weight acts downwardly on the seat link and, in turn, on the front and rear seat carrier links 50,52, and acts to further tilt the latter forwardly to the TV position.

Figure 7:
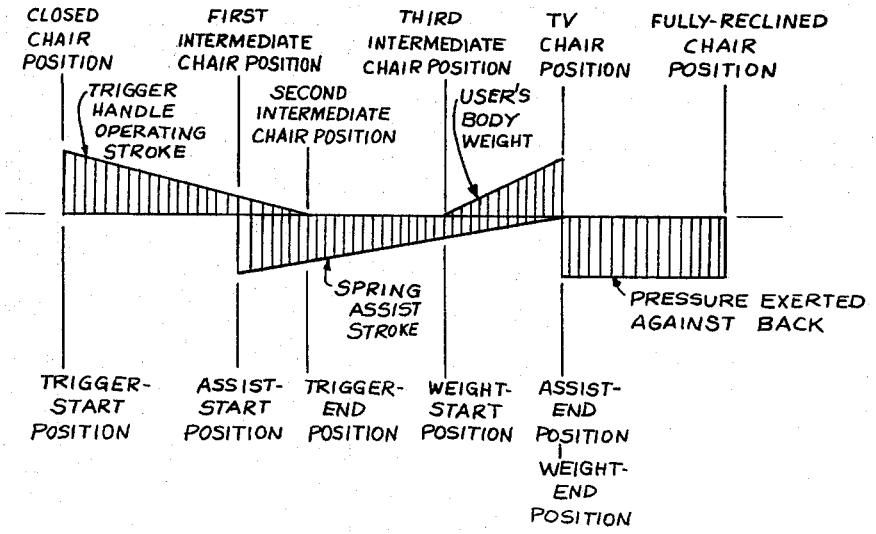
FIG. 7 is a diagrammatic representation of the source and nature and operation of the forces which act on the reclining chair of FIGS. 1–6 to move the chair between its upright, TV and fully-reclined positions.

The operation of the chair from the closed (FIG. 2) to the TV (FIG. 4) position can be alternately described as follows with the aid of the force diagram of FIG. 7. It will be noted that the trigger handle 120 moves along a working stroke from a trigger-start position which corresponds to the upright or closed chair position, to a trigger-end position which corresponds to the second intermediate chair position. The trigger-start position corresponds to the aforementioned first end-limiting handle position. The trigger-end position is located somewhere between the aforementioned first and second end-limiting handle positions. The working stroke is shorter than the operating stroke. In the illustrated embodiment where the operating stroke is approximately 90°, the operating stroke can range from about 50° to about 75°. It will be understood that these arc lengths are merely exemplary, and that any arc length could have been chosen for the operating stroke. Indeed, in some cases, it may be desirable to make the operating stroke to have the same length as the working stroke, in which case the trigger-end position would be located at the aforementioned second end-limiting handle position.

It will be further noted that the spring 170 moves along an assist stroke between an assist-start position which corresponds to the first intermediate chair position (FIG. 3) to an assist-end position which corresponds to the TV position (FIG. 4). The handle 120 is operative to controllably move the spring 170 from its end-limiting horizontal position of FIG. 2 to its inclined FIG. 3 position, wherein the spring suddenly releases its stored-up energy sufficient to drive the chair further forwardly. The assist stroke is shorter than the total operating stroke of the spring; however, if desired, the assist stroke can have the same length as the operating stroke for the spring.

It will be still further noted that the manual force generated by the handle decreases in magnitude as the handle nears the end of its working stroke; and the spring return force likewise decreases in magnitude as the spring relaxes and nears the end of its assist stroke. If the spring assist were initiated after the conclusion of the handle working stroke, then the chair would be characterized by a sudden, non-uniform jerking movement at the transition between the handle drive and the spring drive. Hence, in order to obtain a more uniform chair movement, the assist stroke is begun before the end of the handle working stroke. By having the spring and the handle drive simultaneously operative between the first and the second intermediate chair positions, the chair movement during the transition from the handle to the spring drive is made much more smooth.

Analogously, the user's body weight is advantageously used to smoothen the chair movement at the end of the assist stroke. The force generated by the user's body weight increases in magnitude from the third intermediate chair position to the TV position. This weight force assists the continuously-relaxing spring to affirmatively drive the chair to the TV position. The overlap between the increasing weight force and the decreasing spring return force makes the overall chair movement more uniform.

Once the chair is in the TV position of FIG. 4, the handle and the spring are both no longer operative to drive the chair forwardly. The drive pin 146 has been disengaged, i.e., the drive pin is in impositive engagement with, and out of force-transmitting engagement with, the recliner linkage, thereby permitting the handle to return by gravity to its initial vertical orientation. As for the spring, it has relaxed to its greatest extent. Further reclining movement of the chair to the fully-inclined position of FIG. 5 is caused by the user exerting rearward-directed pressure on the backrest 24, as described above and diagramatically illustrated in FIG. 7.

The footrest 30 is continuously extended from the closed to the TV position; first, by the handle; second by the handle and spring jointly; third, by the spring alone; and fourth, by the spring and the user's body weight jointly.

The non-illustrated other linkage system at the near armrest is jointly and simultaneously moved with the illustrated linkage system in the above-described manner due to the force-transmitting hollow tubular cross-shaft 22 (see FIG. 1) and the other cross-shafts 22*a*, 22*b*.

A considerable mechanical advantage is obtained when the various links are dimensioned and oriented as shown in the drawings. The length of the handle 120 is considerably shorter than the length of the drive link 140; and the drive link 140 moves through a considerably shorter angular distance as compared to the distance through which the handle moves. In accordance with this invention, the handle length has been made very short, on the order of 4", and high mechanical advantages are obtained. Prior art handles are on the order of 9" or more, and therefore, the short handle construction of this invention is very advantageous, particularly from an aesthetic point of view.

To summarize, the wall-proximity chair is initially driven forwardly along an upstream path portion solely by the handle assembly. Thereupon, the spring and the handle are simultaneously operative along an intermediate path portion which extends between the assist-start position and the trigger-end position. Thereupon, the spring is solely operative to drive the chair forwardly until the user's body weight becomes operative at a downstream path portion near the end of the assist stroke. The user reclines the chair to the fully-reclined position by rear pressure exerted on the backrest.

To close the chair from the fully-reclined position, the user leans forwardly, and the chair returns to the TV position. Then, the user exerts leg pressure downwardly on the extended footrest to retract the same. This leg pressure causes the footrest link 79 to pivot rearwardly and to push the push link 150 rearwardly. This movement causes the radius link 160 to pivot clockwise about pivot point 166, and also stretches and tensions the spring 170, until the tensioned spring 150 again passes through and below the pivot point 166. Once the spring 150 lies underneath the pivot point 166, the spring force secures the assist linkage in the over-center locked condition illustrated in FIG. 2.

It will be understood that each of the elements described above, or two or more together, may also find a useful application in other types of constructions differing from the types described above.

While the invention has been illustrated and described as embodied in manually-operated spring-assisted reclining chairs, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a reclining chair of the type having (A) a stationary base for supporting the chair on a floor;

(B) body-supporting means including a seat located generally above the base, and a backrest located rearwardly of the seat;

(C) an armrest located at a side of the seat; and (D) a recliner system at the armrest, and kinematically interconnecting the body-supporting means to the base for reciprocal movement of the body-supporting means relative to the base in forward and rearward directions along a multi-position path which extends between an end-limiting upright chair position in which the body-supporting means is oriented at a predetermined orientation relative to the base, and an end-limiting fully-reclined chair position in which the body-supporting means is oriented at a different reclined orientation relative to the base;

the improvement which comprises:

(a) manually-actuatable means for moving the body-supporting means downstream along the path only in the forward direction from the upright chair position towards an intermediate chair position which is intermediate the end-limiting chair positions, (b) assist means operatively connected to the manually-actuatable means, for forwardly moving the body-supporting means further downstream along the path past the intermediate chair position after the manually-actuatable means has moved the body-supporting means to the general vicinity of the intermediate chair position, to thereby forwardly move the body-supporting means downstream along the path to a greater extent than that obtained by sole operation of the manually-actuatable means, (c) said manually-actuatable means including an actuator member mounted on the armrest within hand-reach of a seated user, for displacement along a working stroke from a trigger-start position which corresponds to the upright chair position, to a trigger-end position which corresponds to the intermediate chair position, (d) said manually-actuatable means being in force-transmitting relationship with, and affirmatively forwardly driving, the recliner system throughout the displacement of the actuator member as it is being displaced from its trigger-start position towards its trigger-end position, to thereby forwardly move the body-supporting means downstream of the path towards the intermediate chair position, (e) said manually-actuatable means being in impositive engagement, and out of force-transmitting relationship with, the recliner system when the actuator member reaches the trigger-end position, to thereby disengage the manually-actuatable means from the recliner system and permit the latter and the body-supporting means to be moved forwardly further downstream along the path towards the fully-reclined position in response to the operation of the assist means and to the body weight of the seated user acting on the recliner system, and (f) said actuator member being returnable from its trigger-end position to its trigger-start position upon disengagement of the manually-actuatable means from the recliner system when the actuator member reaches its trigger-end position.

2. The improvement as defined in claim 1, wherein said assist means includes an energy-storing tensionable member operatively connected to the recliner system, and having a stored energy-release condition in which the tensionable member exerts a tension force of a predetermined magnitude against the recliner system sufficient to drive the same and the body-supporting means forwardly; and wherein said actuator member is operatively connected to the tensionable member for causing the same to assume said energy-release condition after the actuator member has been displaced to the general vicinity of its trigger-end position.

3. The improvement as defined in claim 2, wherein said tensionable member is mounted on the chair for movement along an assist stroke between an assist-start position in which the tensionable member exerts said predetermined magnitude tension force against the recliner system, and an assist-end position in which the tensionable member exerts a tension force of magnitude less than said predetermined magnitude against the recliner system; and wherein said actuator member is in force-transmitting relationship with the tensionable member for moving the same under tension to the assist-start position.

4. The improvement as defined in claim 1, wherein said assist means and said manually-actuatable means are simultaneously operative to move the body-supporting means downstream of the path along an intermediate path portion thereof which lies in the general vicinity of the intermediate chair position.

5. The improvement as defined in claim 3, wherein said actuator member moves the tensionable member to its assist-start position before the actuator member reaches its trigger-end position, to thereby cause simultaneous operation of the assist means and the manually-actuatable means in a portion of the path which lies in the general vicinity of the intermediate chair position.

6. The improvement as defined in claim 1, wherein said manually-actuatable means is primarily responsible for initially moving the body-supporting means along an initial portion of the path, and wherein said assist means is primarily responsible for subsequently moving the body-supporting means along a downstream portion of the path, and wherein said manually-actuatable means and said assist means are both operative to move the body-supporting means along an intermediate path portion which lies between said initial and said downstream path portions.

7. The improvement as defined in claim 3, wherein said manually-actuatable means moves the body-supporting means forwardly at a declining rate of speed as considered in direction from the trigger-start position to the trigger-end position; and wherein said assist means moves the body-supporting means forwardly at a declining rate of speed as considered in direction from the assist-start position to the assist-end position; and wherein said assist means and said manually-actuatable means are simultaneously operative to move the body-supporting means downstream of the path along an intermediate path portion thereof which lies in the general vicinity of the intermediate chair position; and wherein said assist means and said manually-actuatable means together move the body-supporting means along said intermediate path portion at a rate of speed which is greater than that obtained by sole operation of either one of said assist means and said manually-actuatable means, to thereby obtain a smoother, more uniform chair movement during the transition of the driving function from the manually-actuatable means to the assist means at the end of the working stroke.

8. The improvement as defined in claim 3, wherein said assist means moves the body-supporting means forwardly at a declining rate of speed as considered in direction from the assist-start position to the assist-end position; and wherein the body weight of the seated user moves the body-supporting means forwardly at an increasing rate of speed as considered in downstream direction when the assist means approaches its assist-end position; and wherein the assist means and the user's body weight together move the body-supporting means along a portion of the path which lies in the vicinity of the assist-end position at a rate of speed which is greater than that obtained by sole operation of either one of the assist means and the user's body weight, to thereby obtain a smoother, more uniform chair movement at the end of the assist stroke.

9. The improvement as defined in claim 1, wherein the reclining chair is a three-position, wall-proximity, reclining chair having a partially-reclined TV position which lies intermediate the aforementioned end-limiting upright and fully-reclined chair positions, and in which the body-supporting means is oriented at still another reclined orientation relative to the base; and wherein said manually-actuatable means and said assist means are operative to forwardly move the body-supporting means only between the end-limiting upright chair position and the TV chair position.

10. The improvement as defined in claim 9, wherein the recliner system includes means for forwardly moving the body-supporting means from the TV position to the fully-reclined position in response to pressure exerted by the chair occupant on the backrest.

11. The improvement as defined in claim 1, wherein said actuator member is a handle having a handle portion which is more elevated relative to the base in its trigger-end position as compared to its trigger-start position, and wherein said handle is freely returnable under the influence of gravity from its more elevated trigger-end position to its less elevated trigger-start position upon said disengagement of the manually-actuatable means from the recliner system.

12. The improvement as defined in claim 1, wherein said actuator member is a handle mounted on the armrest for pivoting movement about a pivot axis along an operating stroke which extends from one handle end position to an opposite handle end position; and wherein said working stroke is shorter than said operating stroke.

13. The improvement as defined in claim 12, wherein said handle pivots about the pivot axis through an arc length of approximately 90° for the operating stroke, and through an arc length which ranges from approximately 50° to about 75° for the working stroke.

14. The improvement as defined in claim 12, wherein said handle is elongated and extends generally vertically in said one handle end position, and extends generally horizontally in said opposite hand handle end position.

15. The improvement as defined in claim 12, wherein said actuator member is a handle mounted on the armrest for pivoting movement about a pivot axis; and wherein said manually-actuatable means further includes stop means for preventing the user from turning the handle forwardly about the pivot axis, and concomitantly for compelling the user to turn the handle rearwardly about the pivot axis.

16. The improvement as defined in claim 1; and further comprising another armrest located at the opposite side of the chair, and another recliner system at the other armrest; and further comprising means for interconnecting the recliner systems for joint movement.

17. The improvement as defined in claim 1, wherein the chair further comprises a footrest, and a footrest system kinematically interconnecting the footrest to the recliner system for reciprocal movement of the footrest relative to the base from an end-limiting storage position which corresponds to the upright chair position of the recliner system, to an end-limiting fully-extended position which corresponds to the fully-reclined chair position of the recliner system.

18. The improvement as defined in claim 17, wherein the footrest system and the recliner system are both comprised of a plurality of links all integrally kinematically interconnected to constitute an integrated all-linkage system.

19. The improvement as defined in claim 1, wherein said manually-actuatable means includes a driven member operatively connected between the actuator member and the recliner system for forwardly driving the latter during displacement of the actuator member, and a drive member physically and drivingly engaging the driven member as the actuator member is being displaced from its trigger-start towards its trigger-end position, and wherein the drive member is drivingly disengaged from the driven member when the actuator member reaches its trigger-end position.

20. The improvement as defined in claim 19, wherein said manually-actuatable means includes a push link operatively connected between the driven member and the recliner system for forwardly moving the latter in response to movement of the driven member.

21. The improvement as defined in claim 20, wherein the chair further comprises a footrest, and a footrest system kinematically interconnecting the footrest to the recliner system, said footrest system and said recliner system together constituting an integrated all-linkage system; and wherein said push link is operatively connected between the driven member and the footrest system.

22. The improvement as defined in claim 1, wherein said assist means includes a pivotable radius link mounted on the recliner system for pivoting movement about a pivot point, and an energy-storing tensionable spring operatively connected between the armrest and the radius link; and wherein said actuator member is in force-transmitting relationship with the radius link to move the same in a predetermined direction about said pivot point during displacement of the actuator member from its trigger-start to its trigger-end position; and wherein said actuator member is in force-transmitting relationship with the spring to move the same relative to the radius link until the tensioned spring pulls the radius link in the same predetermined direction about said pivot point after said actuator member has reached the general vicinity of its trigger-end position.

23. The improvement as defined in claim 22, wherein said assist means includes a rear extension member connected to the manually-actuatable means; and wherein said spring has one end connected to the armrest, and its other end connected to the rear extension member at a connection point which lies below and rearwardly of the pivot point when the actuator member is in its trigger-start position; and wherein said spring exerts a tension force on said radius link in the direction opposite to said predetermined direction to thereby reliably secure the radius link and the spring in their initial relative starting positions when the actuator member is in its trigger-start position.

24. The improvement as defined in claim 1, wherein said manually-actuatable means includes a handle bracket mounted on the armrest; and wherein said actuator member is a handle mounted on the handle bracket for pivoting movement about a pivot axis along an operating stroke which extends from one handle end position to an opposite handle end position; and wherein said manually-actuatable means further includes an elongated handle link connected to the handle for joint movement therewith; a stop member mounted on the handle link and engaging the handle bracket at one of said handle end positions to prevent movement of the handle past said one handle end position; an elongated drive link having one end region pivotally connected to the handle link; an elongated link having one end region pivotally connected to the opposite end region of the drive link; a drive member mounted on the drive link and physically engaging the driven link as the handle is being displaced from its trigger-start to its trigger-end position; said driven link being physically disengaged from the drive member when the handle reaches its trigger-end position; an elongated push link having a front end region operatively connected to the recliner system, a rear end region operatively connected to the assist means, and an intermediate region pivotally connected to the opposite end region of the driven link.

25. The improvement as defined in claim 24, wherein said assist means includes a support bracket mounted on the recliner system; an elongated radius link having one end region pivotally connected to the support bracket at a pivot point, and an opposite end region pivotally connected to the push link at a point rearwardly of the pivot point when the chair is in the upright position; an extension member integrally connected to the push link and extending rearwardly and downwardly behind said pivot point; and an energy-storing tensionable elongated spring having one end connected to the armrest, and its opposite end connected to the extension member at a connection point which is rearwardly and below said pivot point when the chair is in the upright position.

* * * * *